US006962221B1

(12) United States Patent
Carrette

(10) Patent No.: US 6,962,221 B1
(45) Date of Patent: Nov. 8, 2005

(54) MOBILE ICE FISHING SHELTER ASSEMBLY

(76) Inventor: Paul Carrette, 47738 250th St., Garretson, SD (US) 57030

( * ) Notice: Subject to any disclaimer, the term of this patent is extended or adjusted under 35 U.S.C. 154(b) by 0 days.

(21) Appl. No.: 10/675,273

(22) Filed: Sep. 30, 2003

(51) Int. Cl.[7] ..... B60F 3/00

(52) U.S. Cl. ..... 180/9.1; 180/326; 135/146; 297/344.21; 296/159

(58) Field of Search ..... 180/9.1, 9.46, 180/9.5, 326; 296/159–162, 172, 173, 176; 297/344.21–344.26; 135/88.01–88.05

(56) References Cited

U.S. PATENT DOCUMENTS

| | | | | |
|---|---|---|---|---|
| 3,464,735 | A | 9/1969 | Smith | |
| 3,599,740 | A | 8/1971 | Martinmaas | |
| 3,820,805 | A | 6/1974 | Tuomala | |
| 3,863,727 | A * | 2/1975 | Michrina | 180/9.5 |
| 4,088,363 | A * | 5/1978 | Palmer | 296/161 |
| 4,250,906 | A * | 2/1981 | Rivier et al. | 296/168 |
| 4,480,867 | A * | 11/1984 | Ezell et al. | 296/65.08 |
| 4,671,572 | A * | 6/1987 | Young et al. | 297/344.24 |
| 4,926,893 | A | 5/1990 | Klopfenstein et al. | |
| 5,152,365 | A * | 10/1992 | Aoshima | 180/68.3 |
| 5,341,588 | A | 8/1994 | Lizotte | |
| 5,368,057 | A | 11/1994 | Lubkeman et al. | |
| D364,441 | S | 11/1995 | Mildon | |
| 5,622,198 | A * | 4/1997 | Elsinger | 135/128 |
| 5,653,456 | A | 8/1997 | Mough | |
| 5,720,312 | A | 2/1998 | Scheuermann | |
| 5,732,788 | A * | 3/1998 | Brown | 180/326 |
| 5,749,387 | A | 5/1998 | Thompson | |
| 6,397,870 | B1 | 6/2002 | Makedonsky et al. | |
| 6,439,645 | B1 | 8/2002 | Pedersen | |
| 6,505,694 | B2 * | 1/2003 | Maguire | 180/9.1 |
| 6,523,634 | B1 * | 2/2003 | Gagnon et al. | 180/291 |

* cited by examiner

*Primary Examiner*—Lesley D. Morris
*Assistant Examiner*—L. Lum
(74) *Attorney, Agent, or Firm*—Leonard & Proehl Prof. LLC

(57) ABSTRACT

A mobile ice fishing shelter assembly for permitting quick and easy movement of a mobile shelter designed to facilitate ice fishing. The mobile ice fishing shelter assembly is positionable on a vehicle having a seat portion and a drive assembly, and may comprise a shelter assembly for coupling to the vehicle. The cover assembly is adjustable between a retracted position and a deployed position. The seat portion may include at least one pivotable seat member for adjusting a position of a user to selectively facilitate driving the vehicle and fishing to a side of the vehicle while seated on the seat portion.

16 Claims, 6 Drawing Sheets

MOBILE ICE FISHING SHELTER ASSEMBLY

BACKGROUND OF THE INVENTION

1. Field of the Invention

The present invention relates to fishing shelters and more particularly pertains to a new mobile ice fishing shelter assembly for permitting quick and easy movement of a mobile shelter designed to facilitate ice fishing.

2. Description of the Prior Art

The use of fishing shelters and enclosed winter vehicles is known in the prior art. U.S. Pat. No. 3,599,740 describes an enclosed snowmobile cab assembly. Another type of vehicle enclosure is U.S. Pat. No. 6,439,645 teaching an enclosure for an all terrain vehicle. U.S. Pat. No. 5,368,057 shows a collapsible ice fishing shelter. U.S. Pat. No. 5,720,312 shows a collapsible shelter for use in conjunction with an existing snowmobile. U.S. Pat. No. 6,397,870 shows a portable ice fishing shelter having a hull member. U.S. Pat. No. 5,749,387 provides a portable ice fishing hut that is collapsible into a compact package for transport. U.S. Pat. No. 5,653,456 teaches a ski system for ice fishing shanties. U.S. Pat. No. 5,341,588 and U.S. Pat. No. 4,926,893 each teach another ski-bourn portable ice fishing hut. U.S. Pat. No. 3,820,805 teaches a convertible ice house-snow sled combination. U.S. Pat. No. 3,464,735 teaches a ski-bourn camper to be towed by a snowmobile. U.S. Pat. No. Des. 364,441 shows an ornamental design for a towed ice fishing tent.

While these devices fulfill their respective, particular objectives and requirements, several disadvantages remain including any one or a combination of the following: inability to move the devices quickly; a lack of space; inability to efficiently and safely carry many of the tools and devices used while ice fishing; and undampened bouncing of shacks or shelters supported by statically attached skis or hulls. Therefore, the need remains for a portable ice fishing shelter that is designed specifically to store and carry ice fishing tools and devices while being easily and very rapidly movable to a desired location.

SUMMARY OF THE INVENTION

The present invention meets the needs presented above by modifying the structure of a snowmobile to provide sufficient space and weight distribution to accommodate one or more fishermen while providing rapid mobility.

An object of the present invention is to provide a new mobile ice fishing shelter assembly that substantially integrates a snowmobile structure with an ice fishing shelter resulting in an assembly that is capable of traveling at a very high rate of speed compared to towed or currently known ski-bourn collapsible huts or shanties.

Another object of the present invention is to provide disclosure of necessary or desirable adjustments that can be made to a conventional snowmobile to convert it into a mobile ice fishing shelter assembly consistent with the teachings of the present invention.

Even still another object of the present invention is to provide a new mobile ice fishing shelter assembly that provides adjustable suspension to provide enhanced ride characteristics and superior stability both during transport and when stabilized for fishing.

To this end, the present invention generally comprises a vehicle having a seat portion, a rotatable seat member, and a shelter assembly deployable to form a shelter around the user while the user is seated in the seat member.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
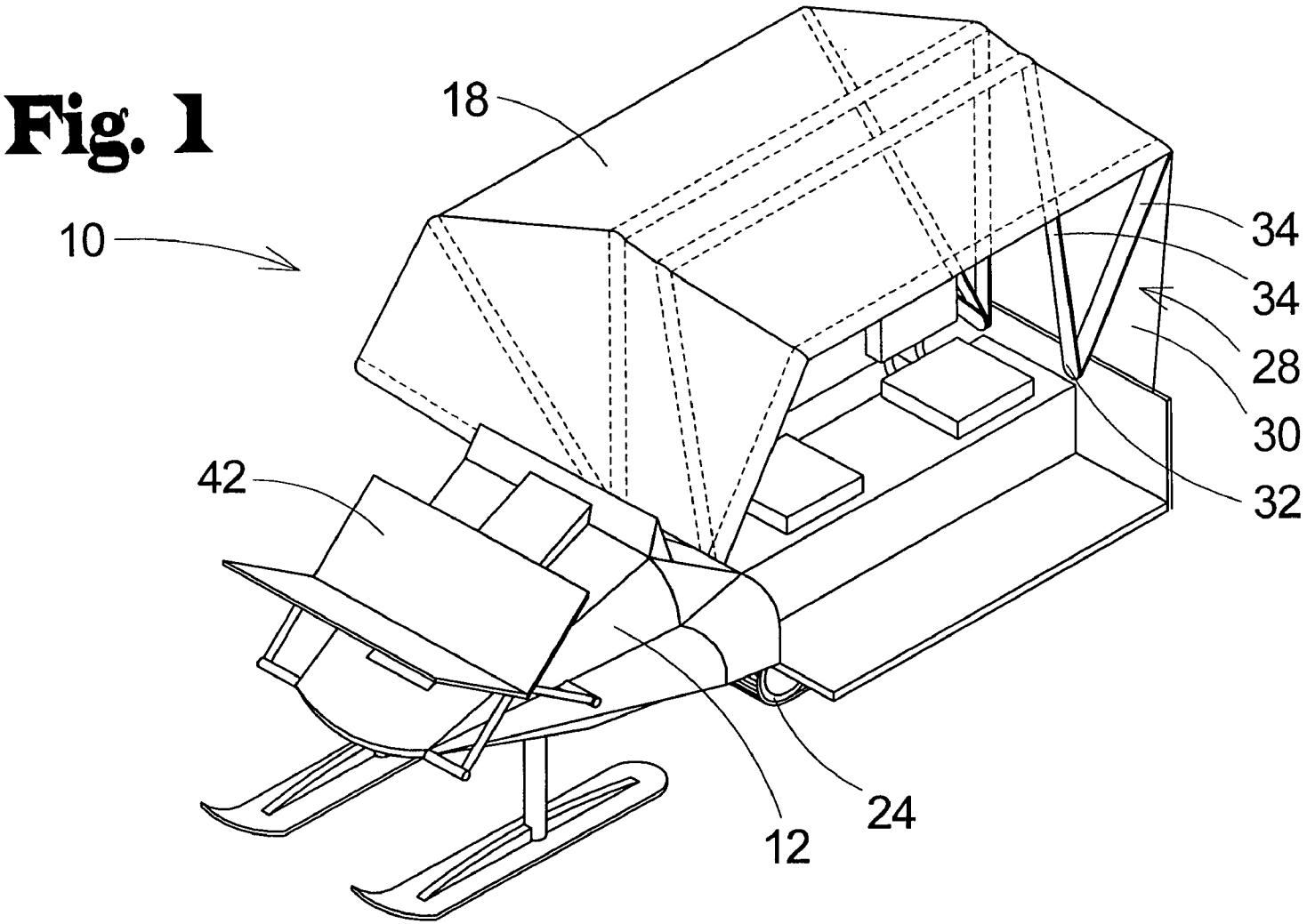
FIG. 1 is a perspective view of a new mobile ice fishing shelter assembly according to the present invention.
Figure 2:
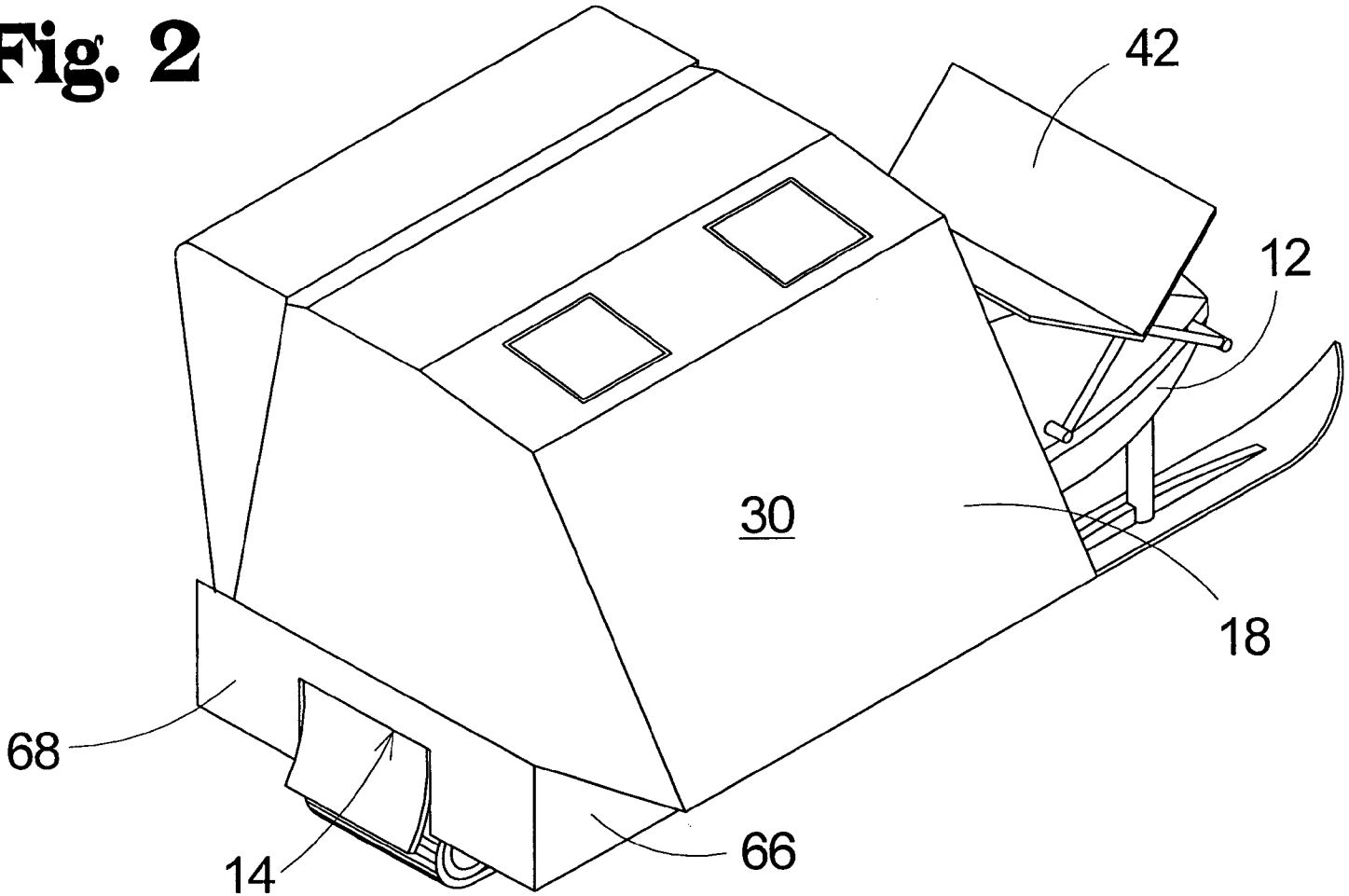
FIG. 2 is a perspective view of the present invention.
Figure 3:
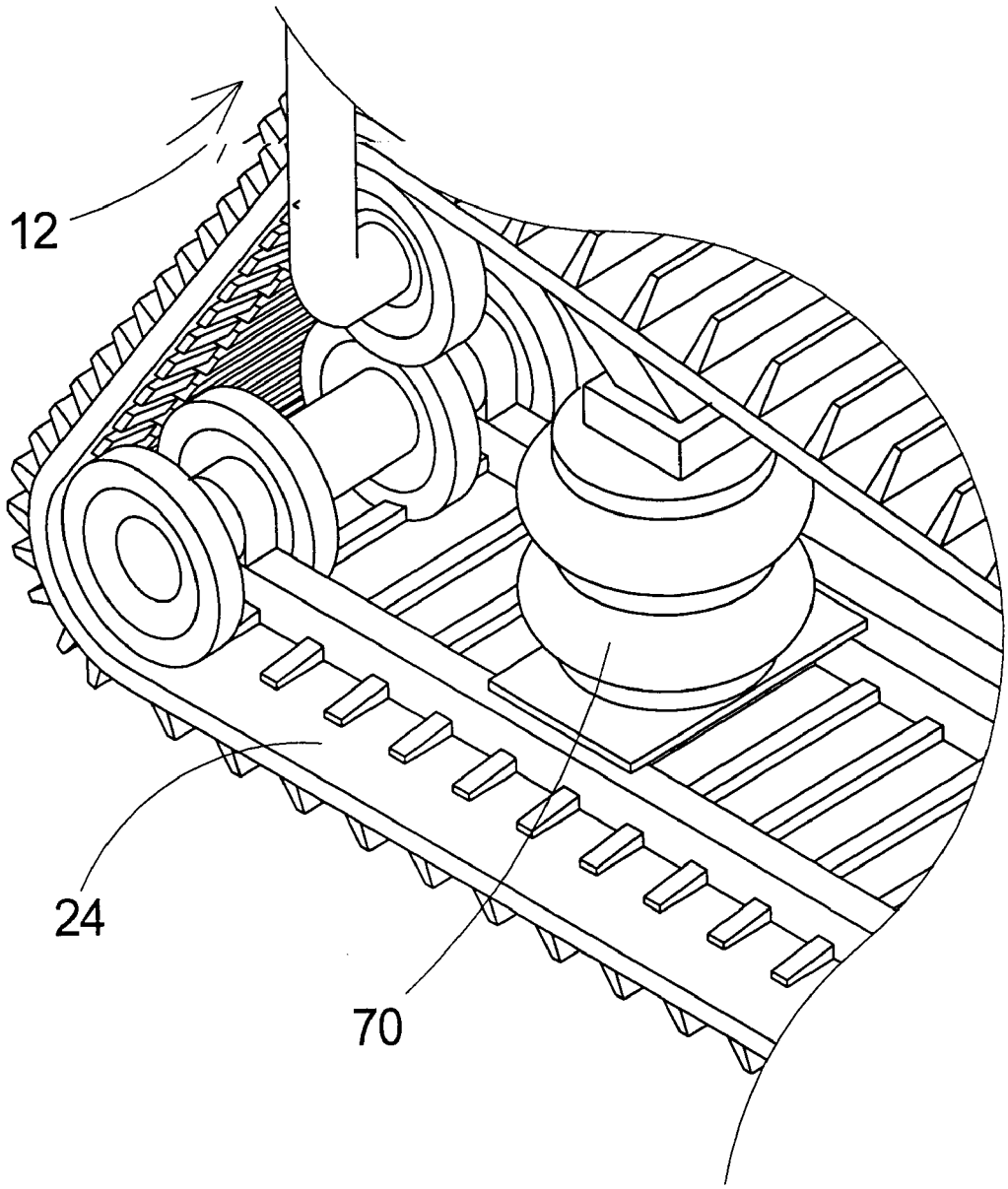
FIG. 3 is a perspective view of the adjustable suspension of the present invention.
Figure 4:
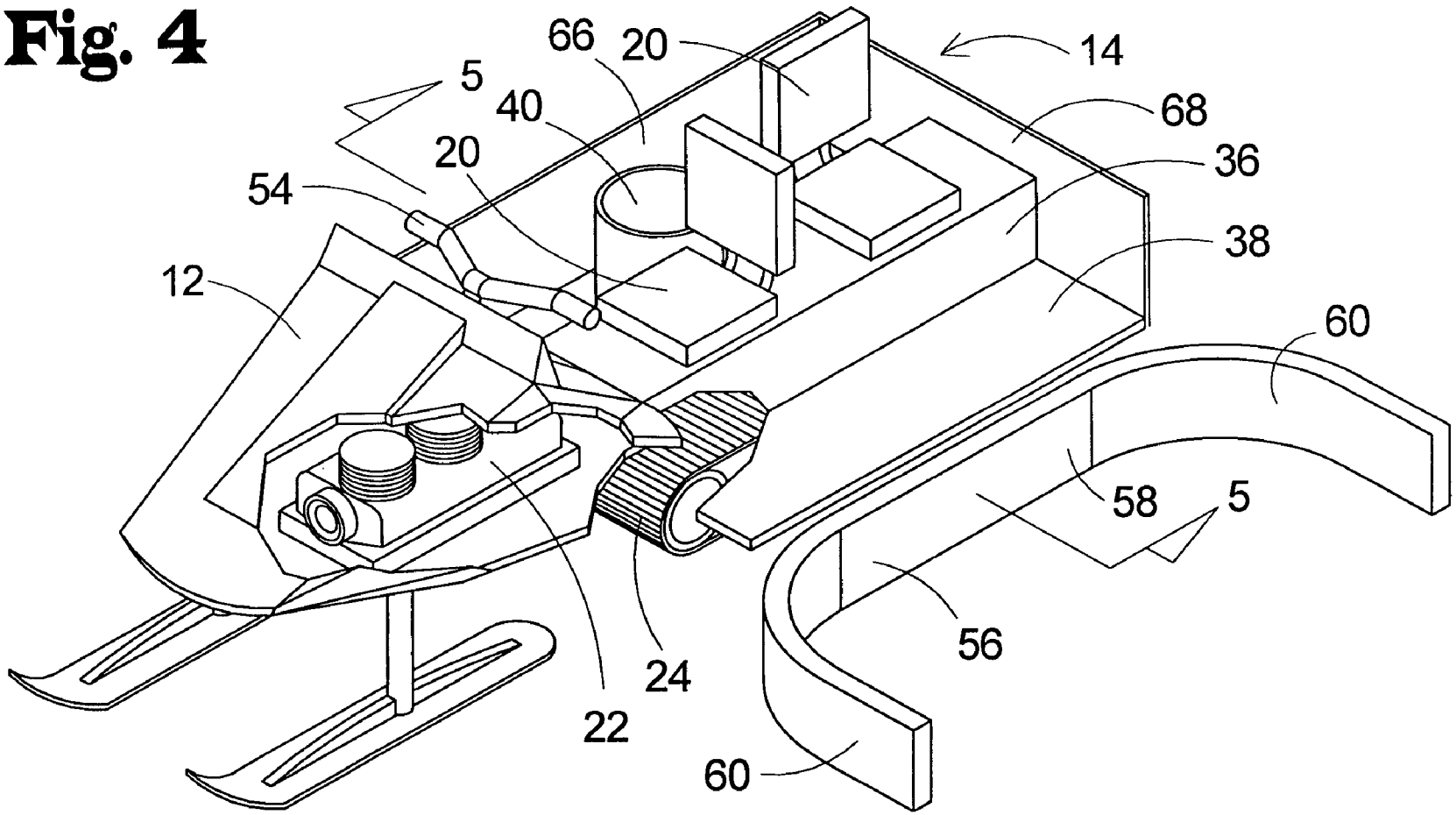
FIG. 4 is a perspective partial cut-away view of the present invention.
Figure 5:
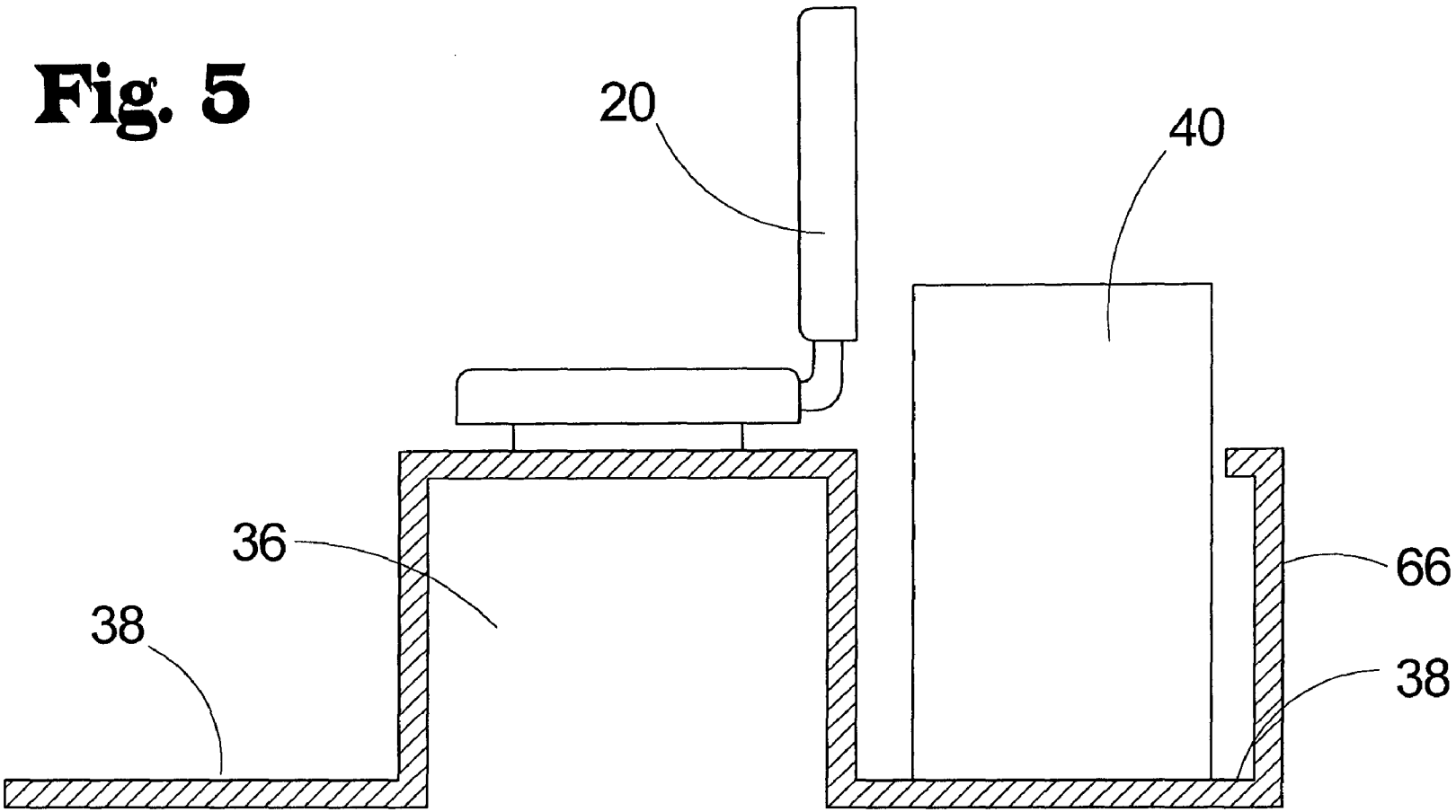
FIG. 5 is a cross-sectional view of the present invention taken along line 5—5 of FIG. 4.
Figure 6:
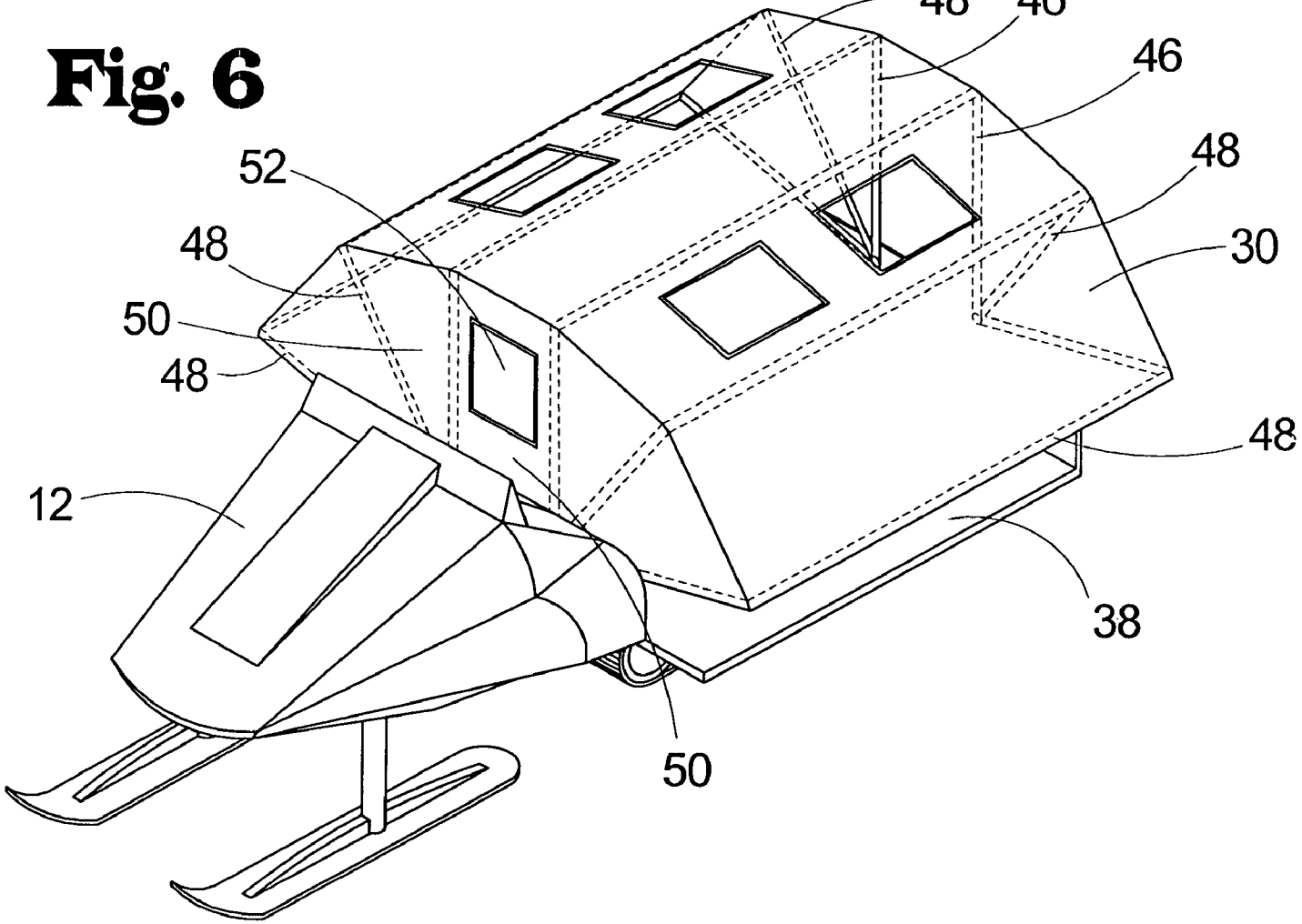
FIG. 6 is a perspective view of an embodiment of the present invention for fishing to either side of the invention.

With reference now to the drawings, and in particular to FIGS. 1 through 6 thereof, a new mobile ice fishing shelter assembly embodying the principles and concepts of the present invention and generally designated by the reference numeral 10 will be described.

As best illustrated in FIGS. 1 through 6, the mobile ice fishing shelter assembly 10 generally comprises a vehicle 12 that includes a seat portion 14 and a drive assembly 16. A shelter assembly 18 is coupled to the vehicle 12. The shelter assembly 18 is adjustable between a retracted position and a deployed position.

The seat portion includes at least one pivotable seat member 20 for adjusting a position of a user to selectively facilitate driving the vehicle 12 and fishing to a side of the vehicle 12 while seated on the seat portion 14. The invention may be designed for fishing to one or both sides of the vehicle 12 and may include more than one seat member 20. It is preferred that the seat members be designed to permit locking of each seat member 20 into place whenever desired.

The drive assembly 16 includes a motor 22 operationally coupled to move a drive track 24 designed for engaging a ground surface to move the vehicle 12. To achieve desired stability, the drive track is substantially lengthened when compared to conventional snowmobiles and may extend outwardly from an end of the seat portion. The seat portion may extend over the entirety of the drive track but it is more often desirable to shorten the seat portion relative to the drive track to achieve desirable weight distribution. The seat portion is designed to be strong and durable and therefore adds weight to the rear portion of the vehicle. Excessive rear weight serves to lift the front of the vehicle during use of the drive track which reduces maneuverability of the vehicle.

In an embodiment, the drive track 24 is selectively retractable into the vehicle 12 using a variable suspension means 70 such as air bags or hydraulics to lower the body of the vehicle to stabilize the invention when the shelter is deployed.

Beyond mere retraction of the suspension, the vehicle preferably includes a suspension assembly adjustable to selectable settings along a continuum using air bags or hydraulics for accommodating variances in weight supported by the vehicle and to provide enhanced user adjustment to suit the particular preferences of the user based on weather conditions, terrain, speed of travel, etc. Thus, the suspension may be stiffened for faster travel or greater weight or softened for added comfort as desired. Further, the setting may be adjusted to position the seat portion in a substantially horizontal orientation while fishing.

The shelter assembly 18 includes a frame assembly 28 and a cover member 30 coupled to the frame assembly 28. In an embodiment of the invention, the frame assembly 28 includes a static connection member 32 and at least one movable frame member 34 coupled to the base member 32. The frame member 34 is typically U-shaped and pivots on the static base member 32. A plurality of frame members may be employed to achieve the desired shape and support of the cover member 30.

The seat portion 14 includes a central portion 36 supporting the seat member 20 and platforms 38 extending outwardly from the central portion 36 for supporting the user's feet. Each of the platforms 38 is positioned on a respective side of the central portion 36. Multiple ice fishing tools are incorporated into the design of the invention including a bucket 40. A width of each platform 38 is sufficient to support the bucket 40 on the platform 38. Typically, the bucket is of the same size as conventional 5 gallon pails already commonly used by ice fishermen.

There may be a vertical outer wall 66 extending up from the outer edge of the one platform, particularly in an embodiment designed for fishing primarily from one side. The outer wall 66 acts in combination with a rear wall 68 and the central portion 36 to form a container area for holding the bucket 40 and other ice fishing items. For comfort, the outer wall may be omitted when fishing is expected from either side of the vehicle, thus providing more foot room for a seated fisherman facing either direction. In such a configuration, depressions to receive the bucket 40 and similar ice fishing tools and devices may be utilized to stabilize these items during transport.

A rack 42 is positioned on a front of the vehicle 12. The rack 42 is designed for carrying equipment such as an auger or spare fuel. The rack 42 is positioned on the front of the vehicle 12 for any one of many reasons including balancing weight distribution on the vehicle 12 to counterbalance the weight of the seat portion, passengers, and shelter assembly. The front positioning also places the tools such as augers where they are easily accessible outside of the sheltered area also preventing fuel odors or fumes from building up within the shelter.

In an embodiment, a frame assembly 18' may include two static base members 46 coupled to the vehicle 12, each being positioned to permit expansion of the shelter assembly to each side of the vehicle 12. The frame assembly 18' further includes a plurality of movable frame members 48, each being coupled to an associated one of the static base members 46 for extending to each side of the vehicle 12. In this configuration, the seat members 20 selectively pivot or rotate towards each side of the vehicle to permit fishing from either side of the vehicle as desired. Further, front portions 50 of the static base members 46 are spaced apart adjacent to the driving position towards the front of the vehicle 12. A portion of the cover 30 extends between the front portions 50 and includes a clear portion 52 that is positioned between the front portions 50 for forming a windshield.

A steering wheel 54 is coupled to the vehicle 12. The steering wheel 54 is tilted upwardly compared to conventional snowmobile configurations for preserving space adjacent to the seat portion 14 and for moving weight forward to achieve better balanced weight distribution on the vehicle 12.

Typically, the shelter when deployed may not reach the ground surface, particularly adjacent to the bottom of the vehicle when it is not in a fully lowered position. It is then desirable to include a retractable skirt 56 coupled to the seat portion 14. The retractable skirt 56 is positionable through pivoting, extension, or other mechanical means of deployment to extend from the seat portion 14 toward the ground surface for preventing wind from entering the shelter from beneath the vehicle 12. The retractable skirt 56 preferably includes a medial portion 58 and a pair of outer portions 60 coupled the medial portion 58. The medial portion 58 is typically coupled to the seat portion 14 and the outer portions 60 are positionable relative to the medial portion through pivoting, extension or other mechanical means of deployment such that the skirt is generally U-shaped when viewed from above and the outer portions extend away from the vehicle 12 adjacent to a bottom of the shelter assembly when the shelter assembly is in the deployed position. Thus, the skirt surrounds an area behind and to the sides of a user seated on the vehicle and pivoted facing out to the side of the vehicle.

In use, the vehicle is moved in much the same way as a conventional snowmobile and similar speeds may be achieved. Upon reaching a desired destination, the user can quickly move to the front of the vehicle to obtain the desired tools to establish a fishing hole and return to one of the seats on the vehicle. The shelter may be deployed to extend over the fishing hole. If desired, particularly if expecting to fish in one location for an extended period of time, the suspension can be lowered to stabilize the invention. If necessary or desired, the retractable skirt can be positioned to help prevent wind. The user is then free to fish within the space defined by the deployed shelter assembly.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A mobile ice fishing shelter assembly comprising:

a vehicle having a seat portion and a drive assembly;

a shelter assembly coupled to said vehicle, said shelter assembly being adjustable between a retracted position and a deployed position;

said seat portion including at least one pivotable seat member for adjusting a position of a user to selectively facilitate driving said vehicle and fishing to a side of said vehicle while seated on said seat portion;

said drive assembly including a drive track adapted for engaging a ground surface for moving said vehicle.

2. The mobile ice fishing shelter assembly of claim 1 wherein said drive track is selectively retractable into said vehicle to lower the vehicle for stabilization while the shelter is in said deployed position.

3. The mobile ice fishing shelter assembly of claim 1 wherein said vehicle includes an adjustable suspension assembly for accommodating variances in weight supported by said vehicle such that said seat portion is in a substantially horizontal orientation during use.

4. The mobile ice fishing shelter assembly of claim 1 wherein said shelter assembly includes a frame assembly and a cover member coupled to said frame assembly.

5. The mobile ice fishing shelter assembly of claim 4 wherein said frame assembly includes a static connection member and at least one movable frame member coupled to said connection member.

6. The mobile ice fishing shelter assembly of claim 1, further comprising:

a rack positioned on a front of said vehicle, said rack being adapted for carrying equipment, said rack being positioned on said front of said vehicle for balancing weight distribution on said vehicle.

7. The mobile ice fishing shelter of claim 4, further comprising:

said frame assembly including two static base members coupled to said vehicle, said frame assembly further including a plurality of movable frame members each being coupled to an associated one of said static base members for extending to each side of said vehicle such that the user is enclosed within said shelter assembly when said shelter assembly is in said deployed position.

8. A mobile ice fishing shelter assembly comprising:

a vehicle having a seat portion and a drive assembly;

a shelter assembly coupled to said vehicle, said shelter assembly being adjustable between a retracted position and a deployed position;

said seat portion including at least one pivotable seat member for adjusting a position of a user to selectively facilitate driving said vehicle and fishing to a side of said vehicle while seated on said seat portion;

wherein said shelter assembly includes a frame assembly and a cover member coupled to said frame assembly;

said frame assembly including two static base members coupled to said vehicle, said frame assembly further including a plurality of movable frame members each being coupled to an associated one of said static base members for extending to each side of said vehicle such that the user is enclosed within said shelter assembly when said shelter assembly is in said deployed position;

wherein front portions of said static base members are spaced apart adjacent to a front of said vehicle;

a portion of said cover extending between said front portions of said static base members; and said cover including a clear portion being positioned between said front portions of said static base members for forming a windshield.

9. The mobile ice fishing shelter of claim 1, further comprising:

a steering wheel coupled to said vehicle, said steering wheel being tilted upwardly for preserving space adjacent to said seat portion and for balancing weight distribution on said vehicle.

10. A mobile ice fishing shelter assembly comprising:

a vehicle having a seat portion and a drive assembly;

a shelter assembly coupled to said vehicle, said shelter assembly being adjustable between a retracted position and a deployed position;

said seat portion including at least one pivotable seat member for adjusting a position of a user to selectively facilitate driving said vehicle and fishing to a side of said vehicle while seated on said seat portion;

a skirt being positionable to extend from said seat portion toward the ground surface for preventing wind from entering said shelter assembly from beneath said vehicle.

11. The mobile ice fishing shelter assembly of claim 10, further comprising:

said skirt having a medial portion and a pair of outer portions coupled said medial portion, said medial portion being coupled to said seat portion, said outer portions being positionable relative to said medial portion such that said skirt is generally U-shaped and said outer portions extend away from said vehicle adjacent to a bottom of said shelter assembly when said shelter assembly is in said deployed position.

12. The mobile ice fishing shelter assembly of claim 1, wherein said drive track is selectively retractable into said vehicle to lower the vehicle for stabilization while the shelter is in said deployed position;

wherein said vehicle includes an adjustable suspension assembly for accommodating variances in weight supported by said vehicle such that said seat portion is in a substantially horizontal orientation during use;

wherein said shelter assembly includes a frame assembly and a cover member coupled to said frame assembly;

wherein said frame assembly includes a static connection member and at least one movable frame member coupled to said connection member;

wherein said seat portion includes a central portion supporting said seat member and a platform extending outwardly from said central portion for supporting the user's feet;

wherein said platform is a first side platform, said seat portion further including a second side platform, each of said first and second side platforms being positioned on a respective side of said central portion of said seat portion;

further comprising a bucket, and wherein a width of said platform is sufficient to support said bucket on said platform;

further comprising a rack positioned on a front of said vehicle, said rack being adapted for carrying equipment, said rack being positioned on said front of said vehicle for balancing weight distribution on said vehicle;

wherein said frame assembly includes two static base members coupled to said vehicle, said frame assembly further including a plurality of movable frame members each being coupled to an associated one of said static base members for extending to each side of said vehicle such that the user is enclosed within said shelter assembly when said shelter assembly is in said deployed position;

wherein front portions of said static base members are spaced apart adjacent to a front of said vehicle;

wherein a portion of said cover extends between said front portions of said static base members;

wherein said cover includes a clear portion being positioned between said front portions of said static base members for forming a windshield;

further comprising a steering wheel coupled to said vehicle, said steering wheel being tilted upwardly for preserving space adjacent to said seat portion and for balancing weight distribution on said vehicle;

further comprising a skirt being positionable to extend from said seat portion toward the ground surface for preventing wind from entering said shelter assembly from beneath said vehicle; and wherein said skirt has a medial portion and a pair of outer portions coupled said medial portion, said medial portion being coupled to said seat portion, said outer portions being positionable relative to said medial portion such that said skirt is generally U-shaped and said outer portions extend away from said vehicle adjacent to a bottom of said shelter assembly when said shelter assembly is in said deployed position.

13. A mobile ice fishing shelter assembly comprising:

a vehicle having a seat portion and a drive assembly;

a shelter assembly coupled to said vehicle, said shelter assembly being adjustable between a retracted position and a deployed position;

said seat portion including at least one pivotable seat member for adjusting a position of a user to selectively facilitate driving said vehicle and fishing to a side of said vehicle while seated on said seat portion;

said seat portion including a central portion supporting said seat member and a platform extending outwardly from said central portion for supporting feet of the user; and a skirt being positionable to extend from said seat portion toward the ground surface for preventing wind from entering said shelter assembly from beneath the vehicle.

14. The mobile ice fishing shelter assembly of claim 13 wherein said platform is a first side platform, said seat portion further including a second side platform, each of said first and second side platforms being positioned on a respective side of said central portion of said seat portion.

15. A mobile ice fishing shelter assembly for positioning on a vehicle, said mobile ice fishing shelter assembly comprising:

a shelter assembly for mounting on the vehicle, said shelter assembly being adjustable between a retracted position and a deployed position; and a seat portion for mounting on the vehicle, said seat portion including a central portion and a platform extending outwardly from said central portion for supporting feet of the user;

at least one pivotable seat member on said central portion of said seat portion for adjusting a position of a user to selectively facilitate driving said vehicle and fishing to a side of said vehicle while seated on said seat member;

wherein said seat portion includes a substantially vertical outer wall mounted on said platform and positioned in a spaced and substantially parallel relationship to said central portion of said seat portion.

16. A mobile ice fishing shelter assembly for positioning on a vehicle, said mobile ice fishing shelter assembly comprising:

a shelter assembly for mounting on the vehicle, said shelter assembly being adjustable between a retracted position and a deployed position; and a seat portion for mounting on the vehicle, said seat portion including a central portion and a platform extending outwardly from said central portion for supporting feet of the user;

at least one pivotable seat member on said central portion of said seat portion for adjusting a position of a user to selectively facilitate driving said vehicle and fishing to a side of said vehicle while seated on said seat member;

wherein said seat portion includes a substantially vertical rear wall extending substantially perpendicular to a length direction of said central portion of said seat portion, said rear wall being mounted on at least a portion of said platform and at least a portion of said central portion of said seat portion.

* * * * *